United States Patent [19]

Kunczynski

[11] Patent Number: 4,596,106

[45] Date of Patent: Jun. 24, 1986

[54] SKI LIFT TOWE SAFETY APRON

[76] Inventor: Jan K. Kunczynski, 2400 Arrohead Dr., Carson City, Nev. 89701

[21] Appl. No.: 661,602

[22] Filed: Oct. 17, 1984

[51] Int. Cl.[4] ..... E04C 3/30; B32B 3/12

[52] U.S. Cl. ..... 52/728; 47/23; 5/455; 428/76; 428/99; 428/68

[58] Field of Search ..... 47/23; 5/449, 455, 441; 52/170, 516, 728; 428/68, 76, 99; 405/216

[56] References Cited

U.S. PATENT DOCUMENTS 1,361,453 12/1920 Frey ..... 5/449 X 2,731,652 1/1956 Bishop ..... 5/455

*Primary Examiner*—Alexander S. Thomas

*Attorney, Agent, or Firm*—Manfred M. Warren; Robert B. Chickering; Glen R. Grunewald

[57] ABSTRACT

A cushion assembly for cushioning obstacles to prevent injury to skiers. Inflated gas bladders are held upright against obstacles such as ski lift support columns. The materials used for fabrication are selected to be substantially water-impervious so that melted snow cannot refreeze and create an undesirably rigid cushion that will injure a skier who skis into it. The cushion assembly is adjustable to include as many bladders as necessary to cushion the obstacle against skier impact.

6 Claims, 3 Drawing Figures

SKI LIFT TOWE SAFETY APRON

BACKGROUND

The field of this invention relates generally to systems for protecting skiers from injury from structures and obstacles on a ski slope, and more particularly, relates to a cushion assembly for wrapping around ski lift, chair lift or gondola tower support columns to prevent injury to skiers who accidentally careen into the columns.

Present technology provides apparatus for padding ski towers and other obstacles on ski slopes to prevent injury to skiers upon collision. However, there are deficiencies in existing padding systems.

The padding systems now in use typically include a canvas apron which is filled with a soft material, such as cotton fibers. This soft cushion is attached to the base of a chair lift tower, to extend from the ground up to a height generally exceeding six feet from the ground. Thus erected, the cushions are designed to provide padding adequate to prevent serious injury to skiers who collide with the tower structure.

However, moisture is a major problem with these padding-based cushions. Over time, water penetrates the canvas apron and becomes absorbed by or otherwise trapped in the soft cushion padding. During the winter ski season, temperatures frequently vary above and below the nominal 32° F. freezing temperature of water. When this happens, the snow melts, migrates into the padding and the water now absorbed or trapped by a padding freezes to form hard unyielding ice. The effect of this is to convert the previously soft pads into solid rigid members which are so hard that a skier can be injured by the frozen padding alone.

Another serious deficiency of such prior art padded cushion assemblies is that the only way to known if the cushions are frozen or not is for a person to push on one. It is not possible to merely see from a distance whether or not a cushion is frozen. Lift operators or the ski patrol must periodically feel the cushion assemblies to be certain that they are safe, and as a practical matter this is done only when the snow depth changes so much as to require movement up or down of the cushions.

For the frozen cushions to be effective again as pads for the ski tower columns, a sufficient period of time must pass during which the ambient temperature is above the freezing point of water to permit the cushion to thaw out and water to migrate out of the padded cushion. As long as moisture remains in the cushion, the cushioning effect is reduced, and upon freezing, the cushion returns to a rock-hard state. Additionally, the presence of moisture in the cushion material and constant cycling between ice and water with temperature changes gradually degrades the material and the performance of the cushion.

SUMMARY OF THE INVENTION

This invention provides an improved cushion assembly for cushioning obstacles found on ski slopes to prevent injury to skiers.

The cushion assembly minimizes injury to skiers who accidentally ski into rigid obstacles on a ski slope in freezing temperatures. The invention includes a gas bladder, with both bladder and gas selected to be substantially immune from freezing at the temperatures typically encountered on ski slopes. The bladder or other confining means is mountable on the obstacle, and is provided with a flexible wall that will deflect away from a skier upon impact. By deflecting, the system transfers energy to the contained gas and thereby absorbs the energy of the skier's impact, to minimize injury to the skier as a result of colliding with the cushion assembly and obstacle.

Other features include an assembly wherein: the bladder is inflatable or deflatable through a valve; a plurality of cylindrical inflatable bladders providing redundancy and increased safety are carried in an apron having pockets for receiving the bladders; and the assembly is fabricated to be substantially free of voids capable of holding or retaining water which, if held or retained, can freeze to create an undesirably rigid assembly that will injure a skier who skis into it.

DETAILED DESCRIPTION OF A SPECIFIC EMBODIMENT

Described below is a specific example of what the inventor considers to be the best mode of fabrication and operation of the invention. This is a necessarily narrow example of one of many possible ways to practice the invention. The invention is broader in scope, as set forth in and defined by the claims.

Figure 1:
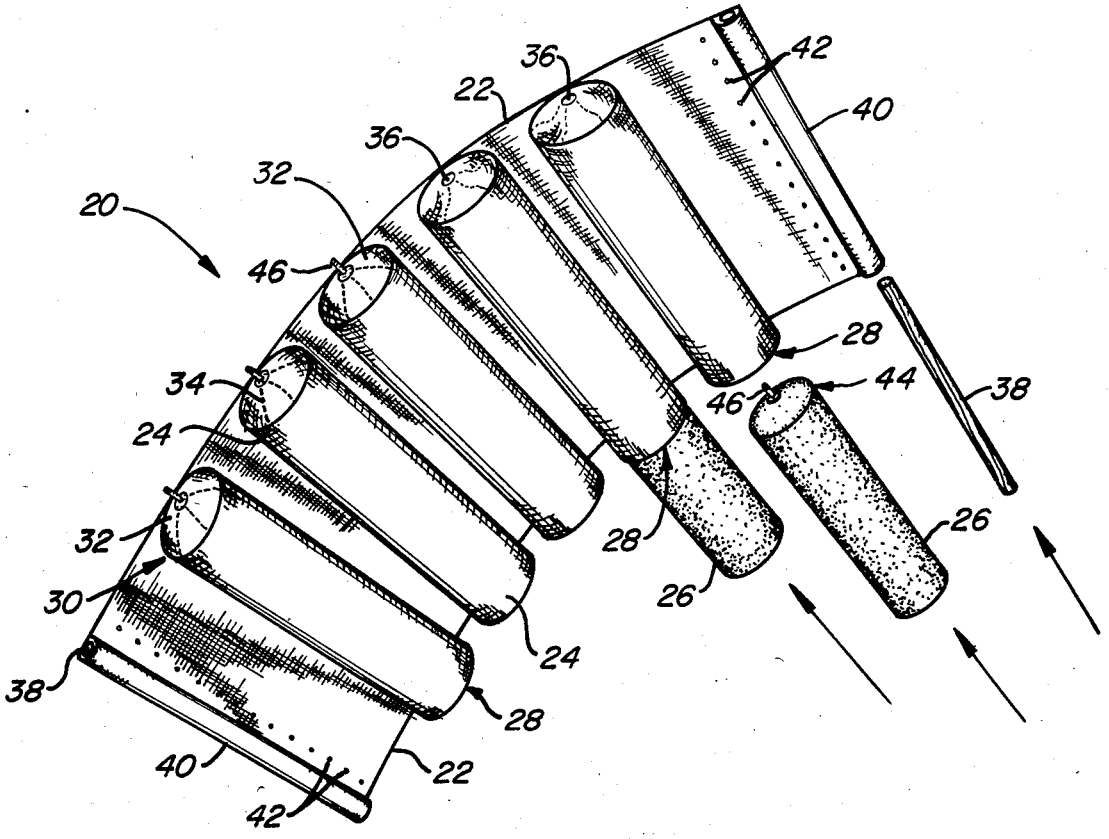
FIG. 1 is a partially exploded orthogonal view of a cushion assembly constructed in accordance with the present invention.
Figure 2:
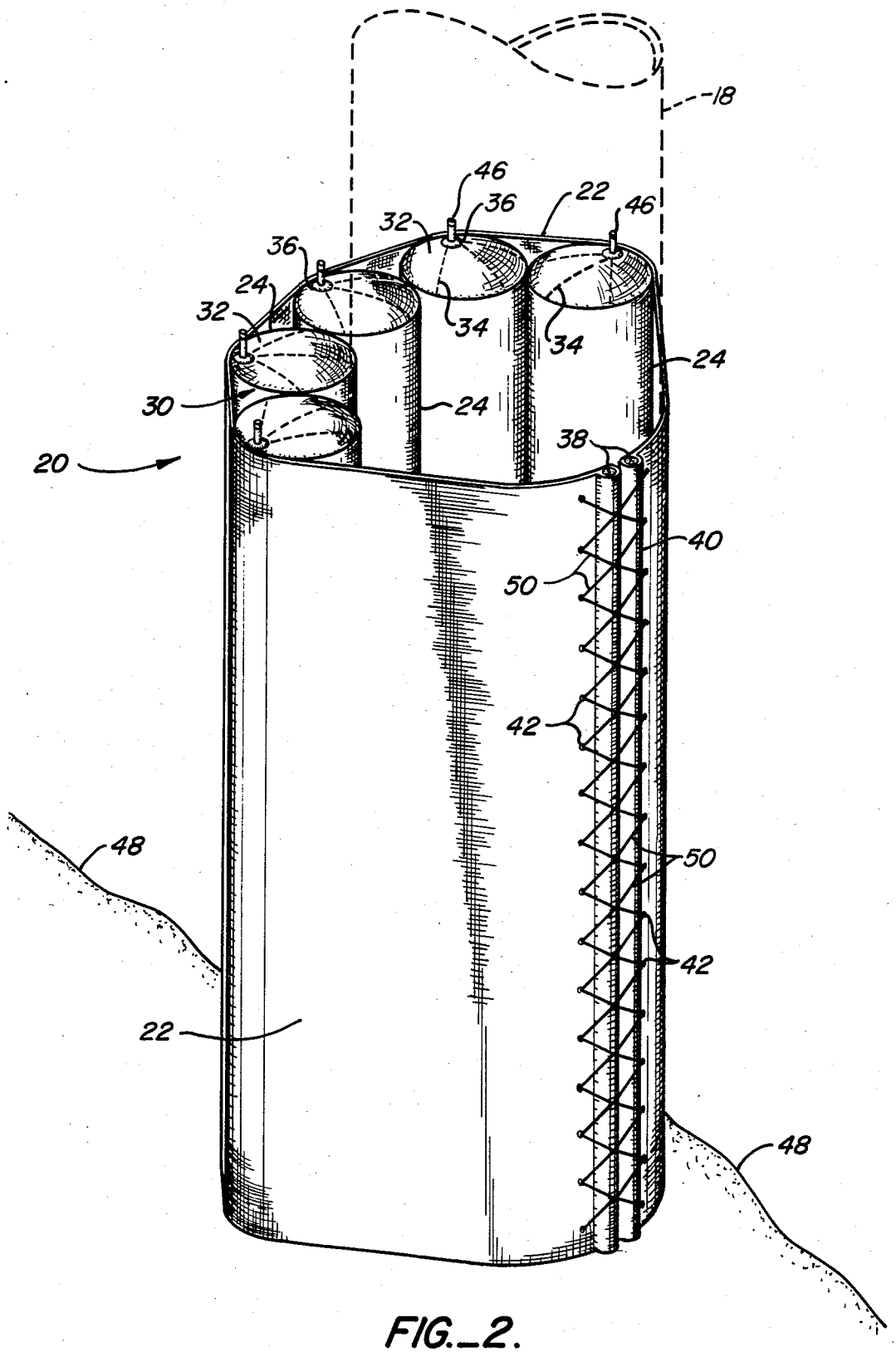
FIG. 2 is an enlarged, orthogonal side view with the FIG. 1 invention mounted on an obstacle.

FIGS. 1 and 2 show an embodiment of the cushion assembly 20, with FIG. 1 showing assembly 20 prior to its mounting in FIG. 2 on an obstacle, such as a ski lift tower column 18. The FIG. 1 assembly 20 includes means for mounting the assembly to a tower or the like, such as an apron 22 provided with hollow cylindrical pockets 24 spaced apart from and substantially parallel to one another. Mounted in each of pockets 24 is an inflatable bladder 26, which provides the cushioning element of the overall assembly.

FIG. 2 shows use. Assembly 20 is positioned with the pockets 24 and bladders 26 mounted vertically on column 18. Cushion assembly 20 is positioned to face the uphill side of the ski slope, because that is the direction from which skiers would possibly collide with tower column 18. When inflated, bladders 26 are inflated to a pressure which is soft enough to not injure the skier, while preventing the skier from hitting column 18.

In order to facilitate handling and installation of the assembly, apron 22 and pockets 24 are integral to one another. Both are typically made from the same type of flexible material such as a canvas formed of a synthetic or natural fiber which will not absorb or retain a sufficient quantity of water so as to rigidify the apron upon freezing of any retained water. Canvas made from nylon or of a water proofed cotton will suffice and can be easily worked by sewing during assembly, to form pockets 24 of various sizes and shapes. Pockets 24 are preferably cylindrical in shape. Each is preferably open at a bottom 28, and closed toward a top 30 with a cap portion 32 having reinforcing stitches 34. A hole 36 is provided in each cap portion 32 for reasons discussed below.

In order to secure the assembly to an obstacle, apron 22 preferably includes reinforcing means, such as a wooden rod 38 fitted into a hollow cylindrical cuff 40 provided at each end of the apron. Mounting means including such apparatus as eyes 42 perforate apron 22 in proximity to reinforced cuffs 40.

Each cylindrical bladder 26 has on its top 44 a valve 46 for inflating and deflating bladder 26. Bladder 26 is pushed into pocket 24 so valve 46 extends through or is accessible through hole 36 of pocket 24. Thus in place, valve 46 can be used to input into bladder 26 a pressurizing gas, such as air or nitrogen. This pressurizing process can be performed at the point of fabrication, but more likely will be done in the field to facilitate easy shipping of assembly 20.

Figure 3:
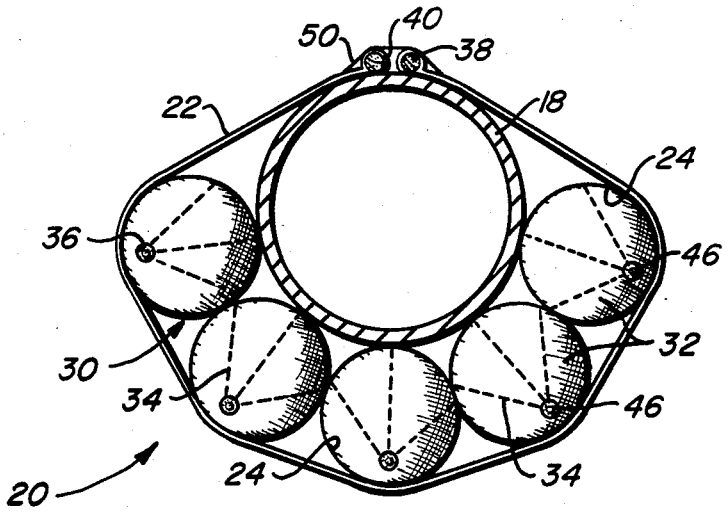
FIG. 3 is a top section view of FIG. 2 taken through section 3—3.

In FIGS. 2 and 3, cushion assembly 20 is shown mounted on tower 18 with apron 22 positioned so bladders 26 face uphill on the ski slope in the direction from which skiers will descend the ski slope. Bottoms 28 of pockets 24 rest on a ground or snow surface 48. A means for mounting apron 22 on tower column 18 can include a rope 50 threaded through eyes 42.

Before tightening rope 50 to secure apron 22 against column 18, a source of pressurizing gas (not shown) is coupled to valve 46 for inflating each bladder 24. Once inflated, each bladder 26 presses firmly against the interior surface of each pocket 24 and against each cap 32, to thereby firmly seat bladder 26 within pocket 24.

With each bladder 26 now inflated, rope 50 is tightened to snuggly mount apron 22 on column 18. With assembly 20 thus in place, a skier who skis into the cushion will impact the gas bladders without serious injury which would otherwise occur if the skier ran into tower 18. Variation in the snow level 48 with respect to tower column 18 can be accommodated by loosening rope 50 and shifting the assembly vertically on the tower.

This invention offers several advantages over existing cushion assemblies. After it is manufactured and before bladders 26 are inserted into the apron, the assembly is compact, simple and rugged for easy transporting to the site in the field. In the field, installation is simple and fast. Bladders 26, if not already positioned in the pockets at the place of manufacture, may be inserted into pockets 24 and inflated. The user can use the number of bladders as is necessitated by the size of the obstacle to be cushioned.

The inflated cushion assembly can be easily inspected by ski area operations personnel from a distance. If a bladder has become deflated it will be readily apparent, for example, from the chair lift. Moreover, a plurality of bladders 26 provides redundancy which enhances safety. If any of the middle bladders should be punctured, the two adjacent bladders will support apron 22 between them away from tower 18 so that the skier will not impact the obstacle. As will be seen from FIG. 3, even loss of an end bladder is not likely to be too serious since the middle bladders extend laterally beyond tower 18 and cushion the tower in the direction from which impacts are most likely.

Further, rope 50 may have a variable length, permiting apron 22 to be easily mounted on a wide size range of obstacles. Additionally the apron can be mounted over ladders on the tower column or under, depending on the ladder structure. Many towers are not provided with ladders because repair and maintenance work is often started by access from the chair or gondola. Moreover, most ladders are on the back side of the tower. If necessary, it will be understood that apron 22 can include openings for hand and foot access to a ladder. For ladders on the uphill side of a column a bladder can be positioned on either side of the ladder with the apron spanning therebetween, or the assembly can be mounted over the ladder with a bladder directly in front of the ladder. As also may be seen from FIG. 3, cushion assembly 20 is constructed to be substantially free of voids which will collect moisture, and therefore ice cannot form within the assembly. The only horizontal surfaces are at the top of the assembly. The assembly also is soft and pliable, permitting it to be effectively used on obstacles having irregular surfaces, such as rocks. The assembly may include as many bladders as necessary to provide cushioning of the obstacle, and multiple bladders are preferred to provide redundancy and greater safety.

What is claimed is:

1. In a combination cushion assembly and obstacle of the type found on a ski slope, said cushion assembly being mounted to said obstacle in a position for impact of said cushion assembly by skiers while skiing on said slope, the improvement comprising:

(a) an inflatable bladder having a flexible wall formed of a substantially water-impervious material which will maintain its flexibility at temperatures at which skiing is conducted, said bladder being inflated with a gas; and (b) a flexible apron formed of a material which will remain flexible at said temperatures, said apron having a pocket therein, said bladder being mounted in said pocket, and said apron being formed for and mounting said bladder while in said pocket to said obstacle.

2. The cushion assembly of claim 1 wherein, said apron and said bladder are fabricated from materials and said apron is formed to mount said cushion assembly to said obstacle in an orientation in which said apron and said bladder are substantially free of voids capable of retaining water.

3. The cushion assembly of claim 1 wherein, said obstacle is elongated, and said apron includes a plurality of cylindrical pockets spaced apart from each other in aligned and parallel relation, a plurality of inflatable cylindrical bladders each formed as defined for the first named bladder and each mounted in said pockets, and said apron is formed to and mounts said pockets and said bladders in substantial alignment with the longitudinal axis of the elongated obstacle.

4. The cushion assembly of claim 3 wherein, said apron includes a cap portion over an upper end of each of said pockets, said cap portion being formed with an opening therethrough for inflation of said bladders.

5. A cushioned ski slope obstacle for minimizing injury to skiers who accidentally ski into said obstacle in weather typified by temperatures at which water freezes, said cushioned ski slope obstacle including said obstacle and a cushion assembly mounted to said obstacle in a position which would be likely to be impacted by skiers in the event of an accident on the ski slope, wherein the improvement in the cushioned ski slope obstacle comprises:

the cushion assembly including an inflatable bladder for confining a gas, the bladder being flexible and further formed of a material which is substantially immune to a substantial loss of flexibility from freezing at the temperatures typically encountered on ski slopes; and the cushion assembly further including bladder mounting means formed for and mounting the bladder to the obstacle, the bladder being filled with a gas and being formed with a flexible wall that will deflect away from a skier upon impact to thereby transfer the energy of impact to the gas and minimize injury to the skier from the confining means and obstacle.

6. A method for minimizing injury to skiers who accidentally ski into rigid obstacles on a ski slope, in weather typified by temperatures at which water freezes, the method comprising the step of:

mounting a deformable non-freezable gas-filled bladder on the obstacle so the bladder will resiliently deform away from a skier on impact to thereby absorb the energy of impact and minimize injury to the skier from the obstacle and bladder.

* * * * *

UNITED STATES PATENT AND TRADEMARK OFFICE

CERTIFICATE OF CORRECTION

PATENT NO. : 4,596,106

DATED : June 24, 1986

INVENTOR(S) : Jan K. Kunczynski

It is certified that error appears in the above-identified patent and that said Letters Patent are hereby corrected as shown below:

In the Title: delete "TOWE" and insert ---TOWER---; and

Column 1, line 36, delete "known" and insert ---know---.

Signed and Sealed this

*Ninth* Day of *September 1986*

[SEAL]

*Attest:*

DONALD J. QUIGG

*Attesting Officer*

*Commissioner of Patents and Trademarks*